United States Patent [19]

Kellogg et al.

[11] Patent Number: 4,723,330

[45] Date of Patent: Feb. 9, 1988

[54] WATERBED MATTRESS COVERINGS

[76] Inventors: David B. Kellogg, 206 Wendy La.; Linda A. Koebler, N5862 Christberg Rd., both of Johnson Creek, Wis. 53038

[21] Appl. No.: 879,018

[22] Filed: Jun. 26, 1986

Related U.S. Application Data

[63] Continuation-in-part of Ser. No. 822,767, Jan. 27, 1986, abandoned.

[51] Int. Cl.[4] ..... A47G 9/02

[52] U.S. Cl. ..... 5/497; 5/495

[58] Field of Search ..... 5/495, 496, 497, 451, 5/485

[56] References Cited

U.S. PATENT DOCUMENTS 2,454,463 11/1948 Kromer et al. .
2,637,049 5/1953 Kromer et al. .
2,994,095 8/1961 Hester .
3,996,633 12/1976 Burke .
4,045,832 9/1977 DiForti ..... 5/496
4,301,561 11/1981 McLeod ..... 5/496

*Primary Examiner*—Alexander Grosz
*Attorney, Agent, or Firm*—Willis B. Swartwout, III

[57] ABSTRACT

Bedclothing for waterbeds comprising a flat generally rectangular panel co-extensive in top plan view dimensions with the upper surface of the mattress. Said panel provided with a least two side drops and one end drop. Said side and end drops coupled at one margin with said panel and at a spaced parallel margin with triangular corner pieces at each end of said end drop. The couplings, drops, panel corner and triangular corner piece cooperating by geometric shape and joinder to form margins defining a pocket and pocket aperture through which the mattress or bladder corner may be manually drawn. At least the corner piece to be formed from top panel material cut on the bias for elasticity. Said aperture margins containing water surge therethrough sand preventing mattress withdrawal therefrom.

8 Claims, 8 Drawing Figures

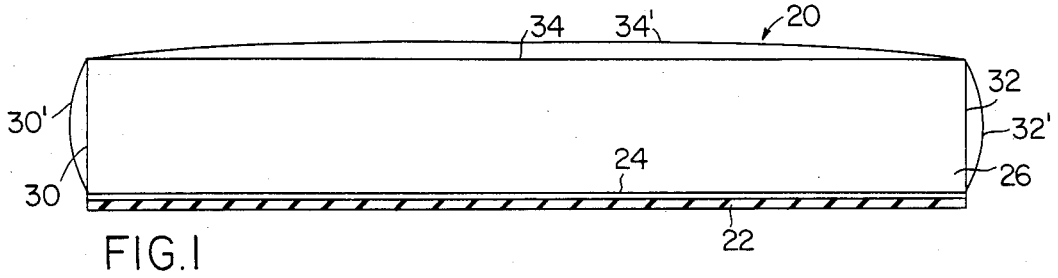
FIG.1
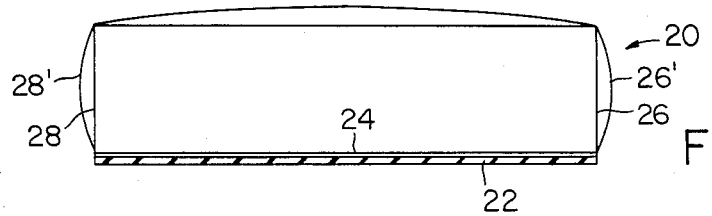
FIG.2
FIG.3
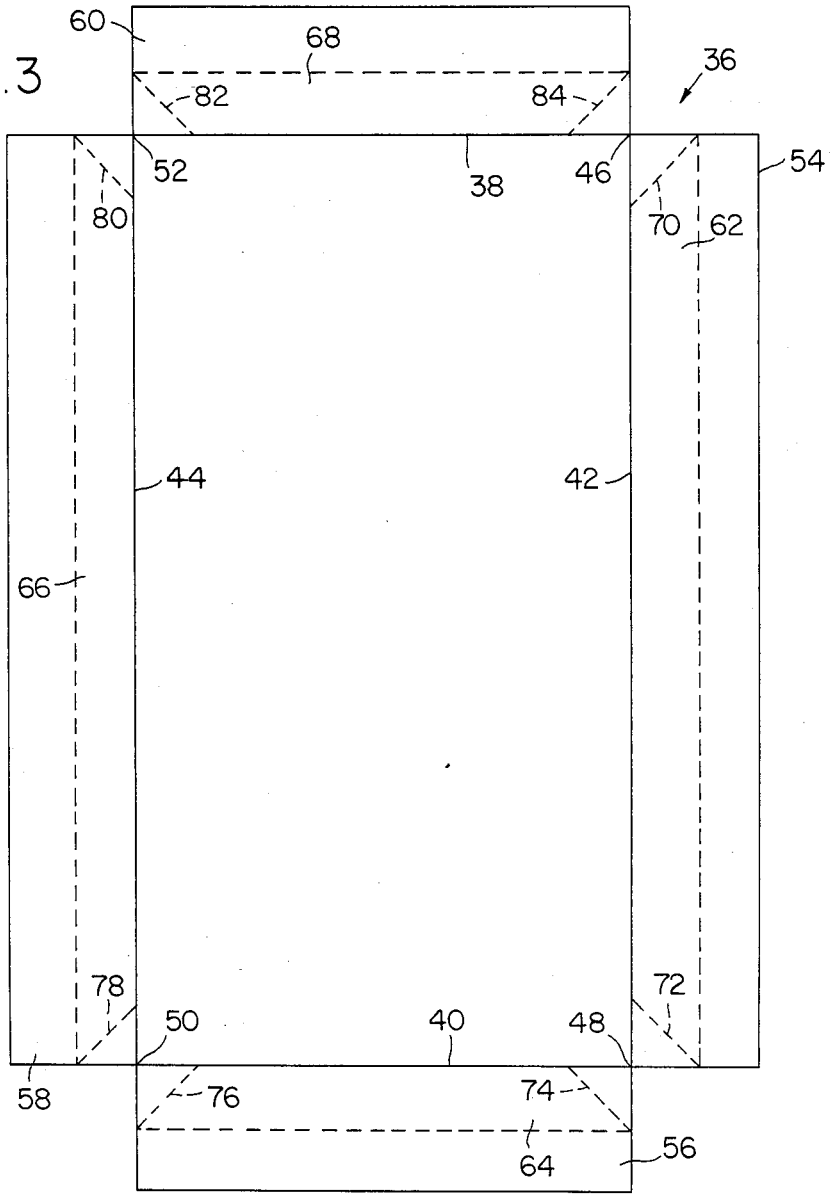

WATERBED MATTRESS COVERINGS

This application is a Continuation-in-Part of our copending Application, Ser. No. 822767, filed Jan. 27, 1986 now abandoned.

BACKGROUND OF THE INVENTION

It will be recalled from our previous application that bedding for waterbeds has presented problems for the waterbed user since the use of waterbeds has become popular. Waterbed mattresses are like bladders that contain water. When weight is placed on the bladder or mattress at one location the water has a tendency to surge outwardly from that location towards the extremities of the bladder or mattress causing the extremities to swell to the extent of its elasticity. This is particularly true around the mattress or bladder corners. Even baffled mattresses or bladders are effected. The result is that the corners of the mattress cover and sheets are forced off of the mattress by the surge effect. Since a surge takes place every time one gets in bed, the result is loose bedding while sleeping and an every morning task of totally remaking the bed.

In addition to the foregoing problem, the mattress will have a tendency to surge just from the making of the bed making it at least frustrating if not impossible to fit the bedclothes back around the mattress corners. Many a bed maker has in time just purchased larger bedclothing and jammed it down between the mattress and the side, head and footboards in an attempt to solve this problem. Such a solution is usually a failure and leads to very uncomfortable sleeping conditions on wadded up sheets and mattress covers.

Various solutions have been attempted in the form of regular or fitted bedclothing for waterbed mattresses. One such attempt has involved the joining of the bedclothing near the foot end of the bed such that the top sheet is sewed to the bottom sheet or both top and bottom sheet are joined near the foot end of the bed to the mattress cover. Such solution has a tendency to result in the restless sleeper tearing or ripping the sheets while sleeping. In addition, the real result is simply to reduce the number of corners to be dealt with, but the problem still remains for the remaining corners.

Another solution that has been tried is to make bedclothing corners which are large enough to accommodate the surge. That solution results in bedclothing that does not fit well and comes loose for that reason. It also causes wadding and uncomfortable creasing of the bedclothes.

A variation on the foregoing scheme was to make the corners from an elastic material in an effort to accommodate the surge. This increases the cost of the materials and the cost of labor to produce the bedclothing and in addition does not solve the problem as a result of the limitations on the elasticity of the material.

Various means have been tried to fasten the bedclothing to the side, head and footboards of the bed with a variety of bad results including ripping, tearing and difficulty in making the bed. There has even been an attempt to solve the problem by having the bedclothing circumscribe the mattress in whole or via elastic straps which is extremely cumbersome in making the bed and changing the bedclothing especially when the weight of a waterbed mattress is taken into consideration.

The proposed solution of our prior application works very well on substantially fully filled, firm mattresses.

However, some users of waterbeds prefer a mattress that is not substantially fully filled and firm. On such mattresses the user discovers that pressure in the central area of the mattress downwardly, as from human weight, causes the mattress margins to turn upwardly giving the mattress a concave appearance. On generally rectangular mattresses, the corners of the mattress experience a short term temporary reduction in water allowing the mattress corner to withdraw from the sheet or mattress cover opening them to come upward within the sheet or cover pulling the sheet or cover with it all along the mattress margins between the corners. This is because the surge will affect the side margins of a generally rectangular in plan view waterbed mattress, which is by far the most common variety.

SUMMARY OF THE INVENTION

The present invention proposes to overcome the problems of the prior art and the problems caused by not substantially filled unfirm mattresses by providing bedclothing having the usual flat panel generally rectangular in top plan view. A generally triangular pocket corner is made from the cover material, but cut on the bias so as to give the triangular pocket corner some elasticity. The base of the triangular pocket corner is free but hemmed. The sides and ends of the generally rectangular bedclothing are provided with elongated side and end drops having spaced parallel top and bottom edges the top edge of the drops being sewed to or formed as part of the sides and ends of the flat panel. The drops are provided for the specific purpose of allowing the sheet or bed clothing to be tucked under the mattress or bladder virtually all around the perimeter of the mattress.

Some waterbed mattresses are formed to have a generally rectangular shape in vertical cross-section through their length and width. Either type of mattress or bladder, however, will tend to conform to the structure which holds it. Thus, in actual use, the mattresses or bladders tend to be generally eliptical in vertical cross-section through either the length or the width, but to have a flat bottom as a result of resting on a sheet of plywood or a similar flat surface. The more completely filled the bladder or mattress is the more pronounced this effect becomes. The mattress therefore tends, when not bearing a significant weight, to be thicker at its center and at the mid-point of the sides and ends than at the corners.

Therefore, the present invention proposes to form an apertured pocket at the corners of the bedclothing, mattress cover or sheet as the case may be by joining the bias cut generally triangular pocket corner to the bottom edge of the side and end drops directly below the corners of the generally rectangular flat panel. The drops may be cut on the bias for further elasticity, if desired, or simply be continuations of the flat panel sides and ends. The end edges of the drops may be provided with V-shaped notches, concave semicircular cut outs or diagonal cut outs thereby defining an aperture between the corner of the flat panel and the bias cut triangular pocket corner through which the mattress or bladder corners may be drawn.

Because of the fact that for tucking in purposes the side drop must exceed in width the thickest portion of the mattress or bladder separate pocket drops either the full length and width of the top panel or only as long as the two sides of the triangular pocket corner but only the thickness of the bladder or mattress at the corners may be used to form the pocket. The largest open area of the aperture may be controlled by selecting one of the several drop shapes above-described such that the aperture margins may place the largest aperture opening directly below the top panel corner or at any desired location relative to the thickness of the mattress or bladder at the corner. For example, for the less fully filled and firm mattresses which tend to have corner curl-up problems, the diagonal cut drops place the maximum aperture opening directly under the top panel corner which prevents the mattress or panel from disengaging from the sheet or pulling the sheet out of its tucked in position which is most desirable for comfortable sleeping.

It is an object of the present invention to provide bedclothing for waterbed mattresses or bladders having a generally rectangular top panel generally co-extensive in length and width with the top surface of the mattress or bladder, a right isosceles triangular corner piece and elongated side and end pocket drops extending from the top panel to the corner piece, the third drops provided with side margins of a desired geometric shape which cooperate with the top panel corner and triangular pocket corner to form a pocket with a suitably shaped aperture to draw through the bladder or mattress corner, said aperture margins being sufficiently pliable or stretchable so as to contain water surge into the mattress or bladder corner and simultaneously prohibit the mattress or bladder corner from withdrawing from bedclothing.

It is a further object of the present invention to provide bed clothing of the character described wherein the drop side margins may be geometrically shaped to define a V-shaped, circular, or diamond shaped aperture.

It is another object of the present invention wherein a second set of side and end tucking drops may be provided for tucking purposes along the sides and ends of said top panel and generally co-extensive with the length of said top panel sides and the width of said ends.

Still another object of the present invention is to provide in a device of the character described first or pocket drops made from the same material as the top panel but cut on the bias from said material and sewed or stitchedly connected to the top panel to provide additional elasticity.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIG. 1 is a side elevational view of a waterbed mattress or bladder resting on a base;

FIG. 2 is an end elevational view of a waterbed mattress or bladder resting on a base;

FIG. 3 is a top plan view of a generally rectangular bedclothing panel with side drops embodying the present invention;

DESCRIPTION OF THE PREFERRED EMBODIMENT

Figure 5:
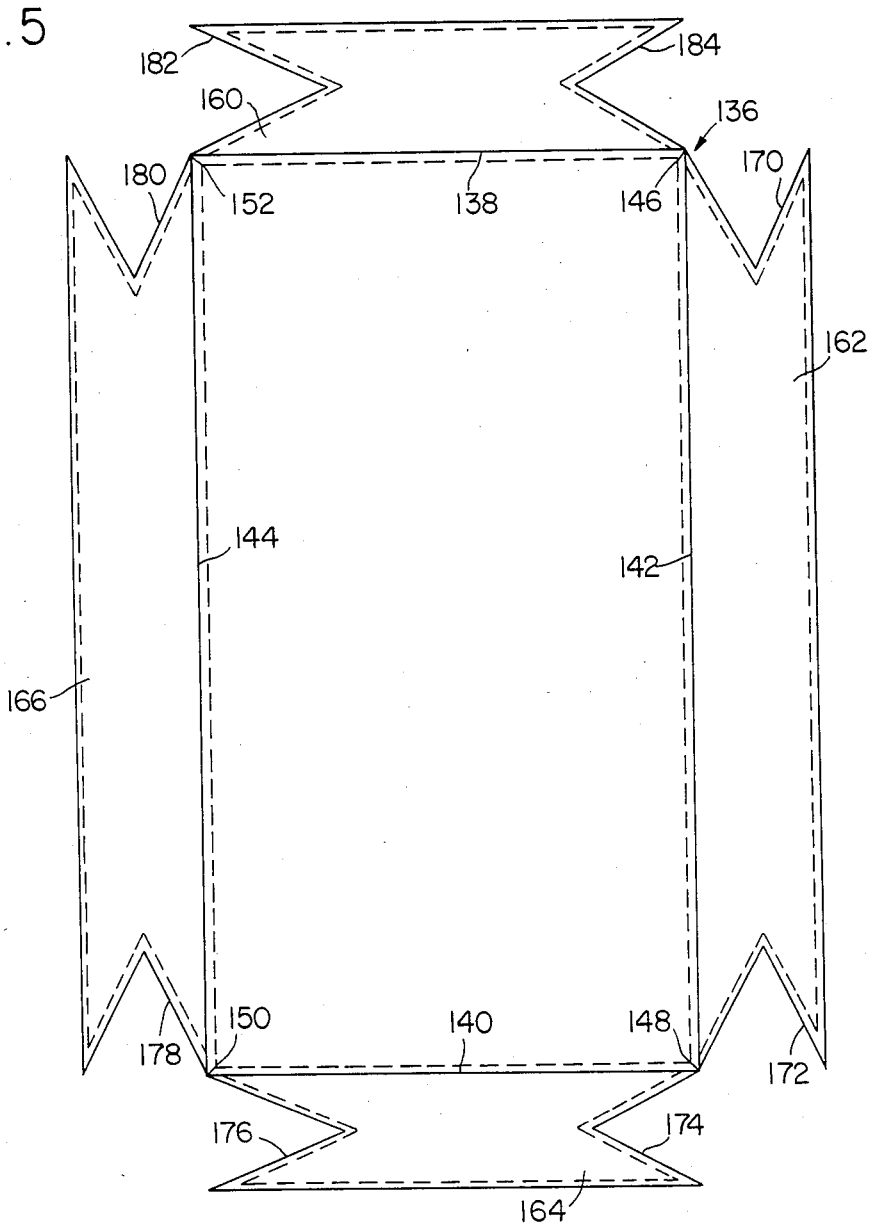
FIG. 5 is a view similar to FIG. 3 showing a second embodiment of the invention.

Referring now to the drawings and more particularly to FIGS. 1 and 2 thereof a waterbed mattress or bladder is shown generally identified by the numeral 20. Mattress 20 is shown in side elevational view in FIG. 1 and in end elevational view 2 as being generally rectangular in shape. Note that mattress 20 is disclosed as though in place in a waterbed frame (not shown) resting upon a plywood bottom board 22. Note further that while board 22 biases the mattress bottom 24 to be as flat as board 22, the mattress sides 26 and 28 and mattress ends 30 and 32 and the mattress top 34 tend to bulge in a curved fashion as denoted by lines 26', 28', 30', 32' and 34'. To some extent, the amount of bulge, caused by the water within the mattress 20, is a function of the amount of water contained in the mattress, the pressure the water exerts on the interior mattress surfaces, and the restraint against bulging that is exerted by the bed frame end and side boards (not shown since this description is primarily for illustrative purposes).

In the substantially well filled mattress 20 shown in FIGS. 1 and 2, the bulge tends to increase as viewed from the margins of any surface toward the geometric center of the surface. In the less well filled mattress 20, the bulge in the top surface 34 illustrated by 34' might decline or surface 34 could even become concave instead of convex as illustrated. Similarly, in the less well filled mattress 20, given the effects of gravity, the high point of the convex sides 26 and 28 as shown by 26' and 28' and the convex ends 30 and 32 as illustrated by 30' and 32' would be lower than illustrated.

Thus, in the less well filled mattress 20, the side, end and corners of the mattress 20 would tend to curve upwardly when downward pressure is exerted on top surface 34 by a human body or other substantial weight. It is this phenomenon that resulted in the improvements applicants have made and included in this Continuation-in-Part application. The phenomenon reduces in proportion to the improvement in mattress fill status but since few, if any, mattresses are perfectly filled, it would be unusual if not impossible to totally eliminate all effects of the phenomenon described.

It should additionally be mentioned that not all mattresses are by design perfectly rectangular from end 30 to end 32 and side 26 to side 28. Often the mattresses are designed to taper from the center toward the sides 26 and 28 and ends 30 and 32. Thus, the mattress is often by design thicker at the geometric center than at the ends and sides.

All of the foregoing circumstances tend to contribute to the fact that waterbed mattress displacement by human use or application of exterior force results in ordinary waterbed bedclothing becoming untucked at the sides and ends and disengaged from the mattress corners. The result is wrinkling and bunching and uncomfortable sleeping as well as daily total remaking of the bed.

Referring now to FIG. 3, a waterbed sheet is disclosed and generally identified by the numeral 36. Sheet 36 is generally rectangular in top plan view. Sheet 36 has end margins 38 and 40 and side margins 42 and 44 forming four right or 90° angle corners. The apexes of these corners are numbered in clockwise rotation 46, 48, 50 and 52 respectively.

Tucking flaps or drops 54, 56, 58 and 60 in clockwise rotation are provided on end margin 38, side margin 42, end margin 40 and side margin 44 respectively. These tucking drops 54, 56, 58 and 60 may be cut on the bias from the sheet material and seamed or stitched to the respective margins if additional elasticity is desired but are disclosed here as being formed in the cutting out process of the sheet itself when it is manufactured. Each of the tucking drops 54, 56, 58 and 60 are generally rectangular and their respective width is greater than the thickness of the mattress sides 26 and 28 and end 30 and 32 over which they will be draped and then tucked under between mattress bottom 24 and board 22.

As viewed in FIG. 3, a plurality of pocket drops 62, 64, 66 and 68 in clockwise rotation are shown in dotted line below tucking drops 54, 56, 58 and 60 respectively. Drops 62, 64, 66 and 68 are cut on the bias from the same material as sheet 36 in the preferred embodiment but could be cut from a more elastic material if desired. Drops 62, 64, 66 and 68 in the preferred embodiment are trapezoidal in plan view and one margin thereof is seamed or stitched to the underside of sheet 36 along the respective end and side margins 38, 40, 42 and 44. Pocket drops 62, 64, 66 and 68 are narrower in width than tucking drops 54, 56, 58 and 60. Note that the margins of pocket drops 62, 64, 66 and 68 respectively remote from margins 38, 40, 42 and 44 of sheet 36 are approximately as long as the length of tucking drops 54, 56, 58 and 60 while the non-parallel sides 70, 72, 74, 76, 78, 80, 82 and 84 of pocket drops 62, 64, 66 and 68 extend convergingly as they approach margins 38, 40, 42 and 44.

Figure 4:
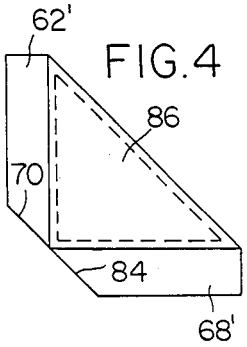
FIG. 4 is a bottom plan view of a variation on the structure shown in FIG. 3.

FIG. 4 of the drawings discloses for exemplification purposes how two pocket drops 68' and 62' are seamed or stitched to a right isosceles triangular pocket corner 86 (the dotted lines in this view denotes the seams) at margins 83 and 85 of corner 86. The pocket drops 68' and 62' are denoted with a prime sign to signify at once their similarity to pocket drops 62 and 68 and at the same time to show an alternative embodiment where the trapezoidal pocket drops on their longest margin are at least the same dimension as the equal sides 83 and 85 of triangular pocket corner 86.

In the foregoing description, it will be seen that the pocket formed has apex 46, the right angle apex 87 of corner 86, and diverging margins 84 and 70 defining a non-closeable elastic V-shaped aperture in the pocket as the corner is viewed in plan through which the user may draw a corresponding corner of mattress 20. This design is considered most preferable because the largest area of the aperture thus formed is toward the upper surface of mattress 20 and best accommodates any curl-up tendency of the mattress.

Figure 7:
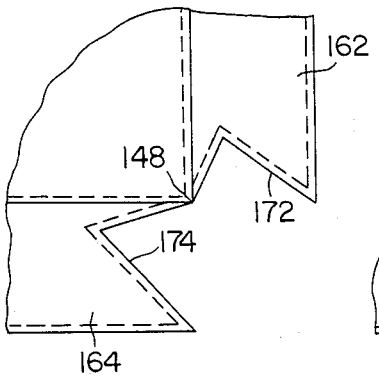
FIG. 7 is a fragmentary top plan view similar to FIG. 5 showing a variation on the structure shown in FIGS. 5 and 6.
Figure 6:
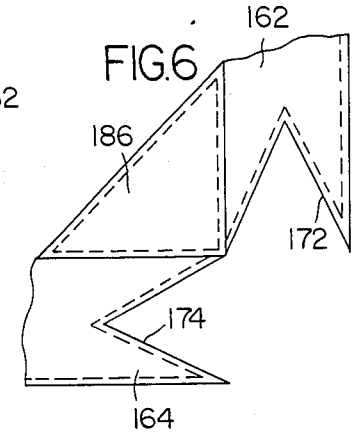
FIG. 6 is a fragmentary bottom plan view of a portion of the structure shown in FIG. 5.

A second embodiment of the present invention is shown in FIGS. 5, 6 and 7 of the drawings with the same or similar structure identified by similar numbers in the one-hundred series. Seams are shown in dotted line. In this embodiment the tucking drops are also the pocket drops and are numbered with tucking drop numbers, however, pocket drops beneath tucking drops similar to the previously disclosed embodiment could equally well be used. Sides 170, 172, 174, 176, 178, 180, 182 and 184 are concavely V-shaped which results in a diamond shaped aperture being defined. Thus, it can also be seen that the maker of the sheets can control by the shape of margins 170, 172, 174, 176, 180, 182 and 184 whether the largest open area of the aperture defined is near the top or bottom of mattress 20 or halfway in between.

Figure 8:
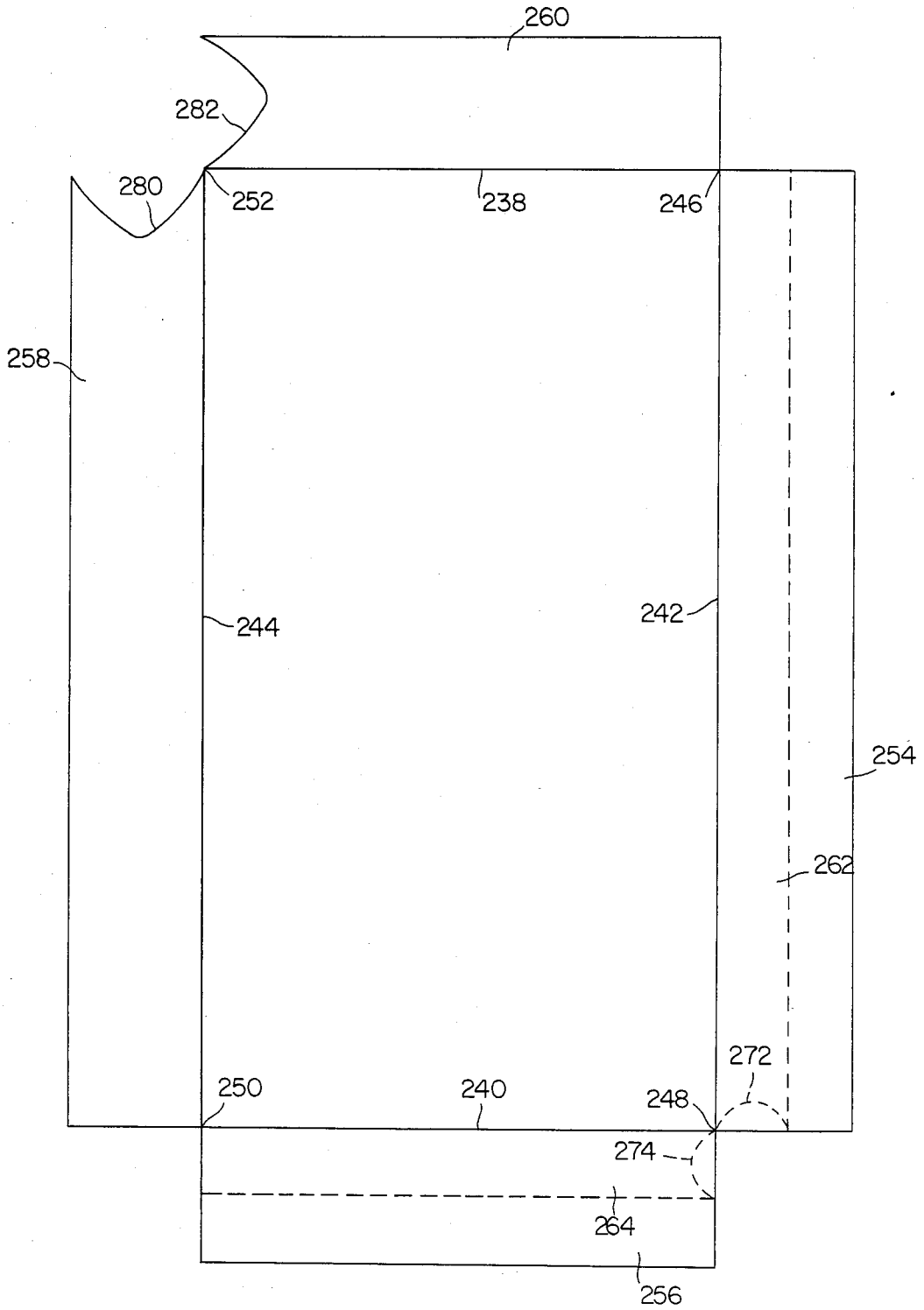
FIG. 8 is a top plan view similar to FIGS. 3 and 5 showing two additional variations on structure embodying the present invention.

Still another embodiment of the present invention is disclosed alternatively in FIG. 8 of the drawings with similar structure identified by similar numbers in the two-hundred series. This view shows how tucking drops 258 and 260 may also serve as a pocket drop or how pocket drops 262 and 264 may be used with the same effect underlying tucking drops 254 and 256.

Note in FIG. 8 that sides 270, 272, 274, 276, 278, 280, 282 and 284 may be concavely arcuate defining a circular aperture when viewed in plan.

In the case of each of the embodiments, it can be seen that elasticized aperture margins are created to surround the mattress corner allowing the corner to expand due to surge without disengaging the sheet pocket. The aperture created is also sufficient to contain without corner disengagement the curl-up tendencies of less well filled mattresses. Thus, a waterbed mattress or bladder covering has been created which solves the prior art problems and provides virtually all the benefits of the so-called contour sheet.

We claim:

1. Bedclothing for waterbeds comprising:

(a) a flat panel of material having a geometric configuration in top plan including at least one angular corner for a waterbed mattress including at least one angular corner;

(b) a pair of bias cut pocket drops depending from the margins of said panel adjacent the angular corner of said panel;

(c) a bias cut triangular pocket corner, the leg edges thereof being joined to the margins of said pocket drops remote from said flat panel; said flat panel angular corner, the pocket drops and said triangular corner forming a pocket the apexes of said flat panel corner and said triangular corner and the margins of said drops extending therebetween defining a non-closeable elastic aperture through which said mattress corners may be manually drawn, said bias cut drops and triangular pocket corner providing elasticity to said margins preventing mattress corner escape when water surge in the mattress causes mattress corner expansion.

2. The structure as set forth in claim 1, wherein said mattress and said flat panel are generally rectangular in top plan view and wherein said panel is provided with at least three bias cut pocket drops, one intermediate two of said panel corners and one on each side of said panel generally perpendicular to the pocket drop intermediate the corners, all of said drops depending from the margins of said flat panel and wherein two triangular panels are provided having a margin leg joined to said panel intermediate the corners and each having a margin leg joined to a margin of one of the side drops remote from said flat panel thereby forming two mattress corner pockets, the apexes of the flat panel, the triangular pocket corner and the file margins of said drops between said flat panel and triangle defining elastically margined apertures in each of said pockets.

3. The structure as set forth in claim 2, wherein said triangular pocket corners are right isosceles triangles and wherein said pocket drops and corners are bias cut from the same material as said flat panel.

4. The structure as set forth in claim 2, wherein said free margins of said pocket drops extending from said triangular pocket corner legs to said panel margins diverge as they approach said panel margins defining a V-shaped aperture in vertical plan.

5. The structure as set forth in claim 4, wherein said free margins of said pocket drops are concavely curved to define a circular aperture in vertical plan.

6. The structure as set forth in claim 4, wherein said free margins are concavely V-shaped defining a diamond shaped opening in vertical plan.

7. The structure as set forth in claim 4, wherein said flat panel is provided with integral rectangular tucking drops overlying said pocket drops along substantially all of each side length and end width of said flat panel, said side and end tucking drops being greater in width dimension than the thickness of the waterbed mattress.

8. The structure as set forth in claim 4, wherein each of the four flat panel corners are provided with pocket drops and triangular corners forming pockets with margins defining an aperture for manually drawing therethrough a mattress corner.

* * * * *